United States Patent [19]

Ericson

[11] Patent Number: 5,052,523

[45] Date of Patent: Oct. 1, 1991

[54] ELEVATOR CAR-MOUNTED GOVERNOR SYSTEM

[75] Inventor: Richard J. Ericson, Southington, Conn.

[73] Assignee: Otis Elevator Company, Farmington, Conn.

[21] Appl. No.: 655,862

[22] Filed: Feb. 14, 1991

[51] Int. Cl.[5] ..... B66B 5/16

[52] U.S. Cl. ..... 187/89; 187/38; 187/81; 187/90

[58] Field of Search ..... 187/38, 77, 79, 80, 187/81, 82, 83, 89, 90; 188/188, 189

[56] References Cited

U.S. PATENT DOCUMENTS

| | | | |
|---|---|---|---|
| 259,951 | 6/1882 | Voerde . | |
| 403,668 | 5/1889 | Heermans | 187/89 |
| 3,934,682 | 1/1976 | Hedstrom | 188/189 X |
| 4,029,177 | 6/1977 | Fiss | 187/89 |
| 4,538,706 | 9/1985 | Koppensteiner | 187/90 |
| 4,662,481 | 5/1987 | Morris et al. | 187/77 |

*Primary Examiner*—Robert P. Olszewski
*Assistant Examiner*—Dean A. Reichard
*Attorney, Agent, or Firm*—William W. Jones

[57] ABSTRACT

An elevator car speed governor is mounted on the top of the car assembly, and measures car speed by contacting a fixed element in the hoistway. The fixed element can be a taut cable extending from the top of the hoistway to the pit, or one of the car guide rails, for example. The governor has a centrifugally operated connection with emergency brakes on the car. When overspeed is detected, the connection is actuated to cause the brakes to engage the guide rails and stop the car. The governor can operate at relatively low overspeed rates, and can be used on elevator systems which do not have an overhead machine room, such as hydraulic and linear induction motor elevators.

9 Claims, 6 Drawing Sheets

ELEVATOR CAR-MOUNTED GOVERNOR SYSTEM

TECHNICAL FIELD

This invention relates to a safety governor for use in an elevator system, and more particularly to a safety governor which is mounted on the elevator car.

BACKGROUND ART

Elevators are provided with safety systems which will initiate an emergency stop of the car in case of overspeed. The device is generally referred to as a governor, and typically includes a rope which is connected to the car and passes over a pulley in the elevator machine room. The governor rope thus, under normal conditions moves up and down with the car and over the pulley. The pulley is connected to a spinning centrifugally operated trip device which is actuated by car overspeed. When car overspeed occurs, the trip device causes movement of the governor rope to stop which in turn pulls a brake actuator on the car thus stopping the car.

Some forms of elevators are not amenable to the above-described governor system because they do not have a conventional machine room. Such elevators include hydraulic elevators; roped and non-roped, linear induction motor elevators, and elevators which travel on a curved path, such as for the Eiffel Tower in Paris. These elevators, nevertheless, should be equipped with safety governors which will stop the car in the event of overspeed. One solution to providing such elevators with safety governors is to place the governor on top of the car assembly. The governor will include a centrifugally actuated brake tripper, and a rotating member which engages a fixed component of the elevator system in the hoistway.

U.S. Pat. No. 259,951 granted June 20, 1882 to F.W. Voerde discloses a safety attachment for elevators which utilizes a cable stretched from the top to the bottom of the elevator hoistway and wrapped around a pulley mounted on the elevator platform. The rotational speed of the pulley is proportional to the speed of the elevator in the hoistway. Several deficiencies are found in the system shown and described in this patent. Firstly, the pulley cable drags over the elevator platform, and is disposed in a very wide groove in the pulley. These two factors will result in excessive rope wear caused by abrasion of the rope by the platform, and by the rope sliding back and forth in the pulley groove. Excessive noise will also be created. These conditions will be further exacerbated by the fact that the rope in the Voerde system is drawn off and apparently fastened to the side of the hoistway. Another difficulty with the disclosed system which is caused by tying the ends of the rope in place in the hoistway arises from rope stretch which will occur from changes in humidity in the environment in the hoistway. Proper rope tension on the pulley thus cannot be maintained, and, as a result, accuracy and dependability of the system cannot be assured.

U.S. Pat. No. 4,662,481 granted May 4, 1987 to K.E. Morris, et al., disclosed an elevator system which includes a safety device mounted on the elevator car. The safety assembly includes a roller which rides on one of the elevator guide rails. The roller will be free wheeling so long as the speed of the elevator remains below a predetermined safe velocity. If an excessive elevator speed is experienced, the excessive roller speed will trip a centrifugal brake which will lock the roller against rotation. The locked roller is then dragged up the guide rail pulling a cable which trips a safety brake on the car. A problem which resides in this approach relates to the ability to develop enough frictional force between the roller and rail to be able to trip the elevator safety. Rail deflections due to typical rail bracket spacing and car ride considerations may not allow sufficient post-post forces to be developed to assure tripping of the elevator safety with this arrangement.

DISCLOSURE OF THE INVENTION

This invention relates to an elevator safety governor which is mounted on the elevator car. The governor includes a roller or pulley which is mounted on the car for rotational movement thereon. The pulley contacts a fixed member in the hoistway, such as one of the guide rails, or a fixed cable strung between the top and the bottom of the hoistway. The rotational speed of the pulley resulting from its contact with the fixed hoistway member is proportional to the speed of the car in the hoistway. The governor pulley has a flyweight assembly mounted on it, which flyweight will selectively operate pivotable pawls mounted on the pulley. The pawls are disposed radially outwardly of a ratchet wheel which is connected to the hub of a safety cable reel. The safety cable is wound on its reel, and an end of the safety cable distal of the reel is connected to a safety brake mounted on the elevator car. Pulling of the safety brake cable will cause the safety brake to stop the car in the hoistway. The upward pull force available to trip the safety is multiplied by the ratio of the pulley diameter to the safety cable pulley diameter. This upward pull force can be several times greater than the force resulting from the design in U.S. Pat. No. 4,662,481. The use of the governor pulley and safety cable reel allows the creation of a mechanical advantage between the pulley and reel so that the necessary cable pulling forces can be generated to trip the safety brakes.

The pawls are normally disposed out of engagement with the ratchet wheel so that normal rotation of the pulley does not result in any rotation of the ratchet wheel. The ratchet wheel and safety cable reel are normally still on the car so that normal rotation of the governor pulley will not result in rotation of the safety cable reel. When governor pulley rotation exceeds a predetermined speed, the flyweight assembly will cause the pawls to engage the ratchet wheel. This results in a connection between the governor pulley and the safety cable reel which, in turn, results in the safety cable being wound up onto the reel. The safety cable is thus pulled to actuate the safety brake, stopping the car. It should be noted that a pawl and ratchet wheel is shown, but that this result can also be achieved using an internal-expanding, centrifugal-acting rim clutch.

It is therefore an object of this invention to provide a car mounted safety governor system for an elevator which senses car speed with a rotating governor pulley mounted on the car.

It is a further object of the invention to provide a governor system of the character described wherein governor pulley rotation is selectively transferred to a safety cable reel to pull a safety cable.

It is another object of this invention to provide a governor system of the character described which can provide sufficient pulling force to trip a safety brake by pulling on the safety cable even in a relatively low speed elevator system.

These and other objects and advantages of the invention will become more readily apparent from the following detailed description of a preferred embodiment thereof when taken in conjunction with the accompanying drawings, in which:

BEST MODE FOR CARRYING OUT THE INVENTION

Figure 1:
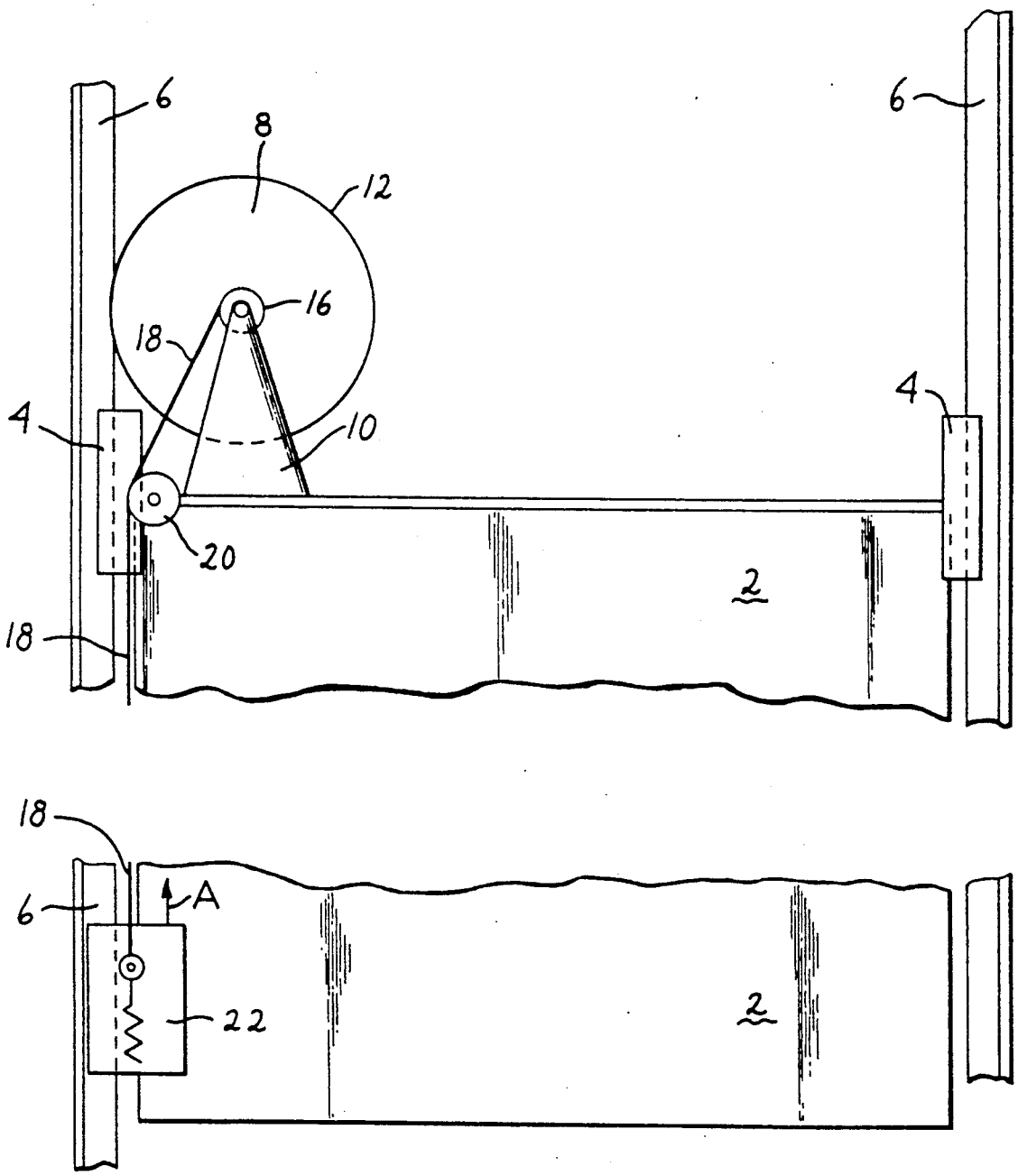
FIG. 1 is a schematic side elevational view of a safety brake governor assembly formed in accordance with this invention which is mounted on an elevator car top and which senses car speed with a pulley contacting one of the elevator car guide rails.
Figure 2:
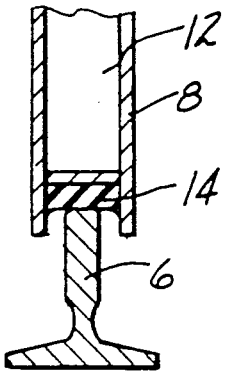
FIG. 2 is a fragmented edge view of the governor pulley periphery showing how it engages the guide rail.

Referring now to FIG. 1, there is shown in somewhat schematic fashion an elevator which includes a car 2 equipped with guide rollers or shoes 4 which move along guide rails 6 to guide movement of the car 2 in the elevator hoistway. A governor pulley 8 is mounted for rotation on a stand 10 disposed on the top of the car 2. The periphery 12 of the pulley 8 contacts and rolls along the blade of the guide rail 6. As shown in FIG. 2, the periphery 12 of the pulley 8 may be provided with a rubber coating 14 which actually contacts the guide rail 6. Adjacent to the pulley 8, and also mounted for rotational movement on the stand 10 is a cable reel 16. The reel 16 carries a tripping cable 18 which passes over an optional deflector sheave 20 mounted on the car 2, and then extends down to an emergency brake or brakes 22 which are mounted on a lower part of the car 2. The brakes 22 are normally held away from the guide rail 6 so as not to interfere with movement of the car 2 over the rails 6. When the cable 18 is pulled in the direction of the arrow A, the brakes 22 are tripped and will tightly engage the rails 6 to stop the car 2. It will be appreciated that brakes 22 may be mounted on both sides of the car 2 so as to operate on both rails 6, there being an interconnection between the brakes 22 so that the cable 18 can trip both of them. Generally any conventional safety brake can be used in conjunction with the governor of this invention, including caliper brakes or wedge brakes. U.S. Pat. No. 4,538,706 granted Sept. 3, 1985 to W. Koppensteiner discloses one type of wedge brake which can be adapted for use with this invention. This patent is incorporated herein in its entirety.

Figure 3:
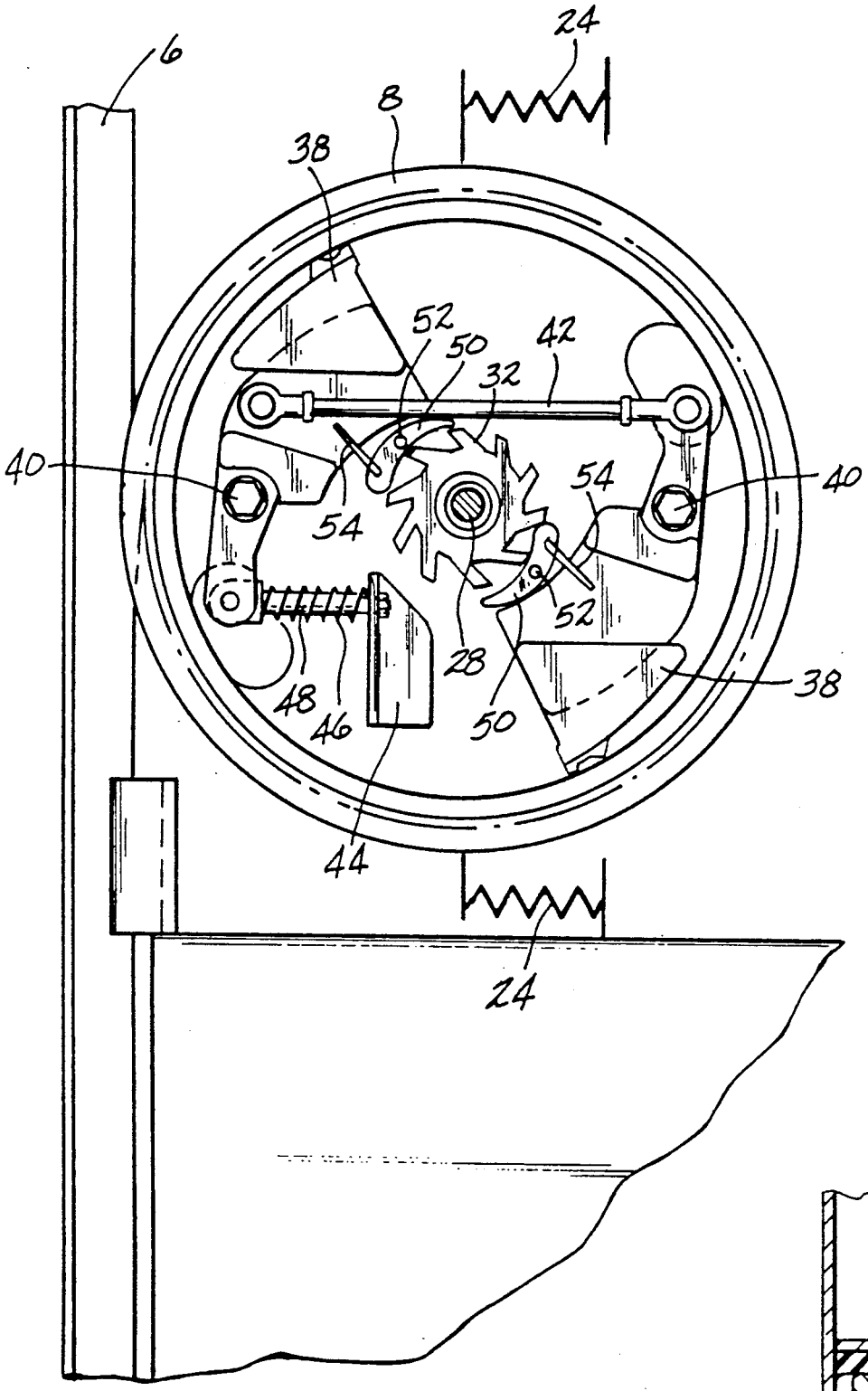
FIG. 3 is a side elevational view of the governor pulley with parts broken away to show the pawl-flyweight mechanism mounted on the governor pulley, and the ratchet associated therewith.
Figure 4:
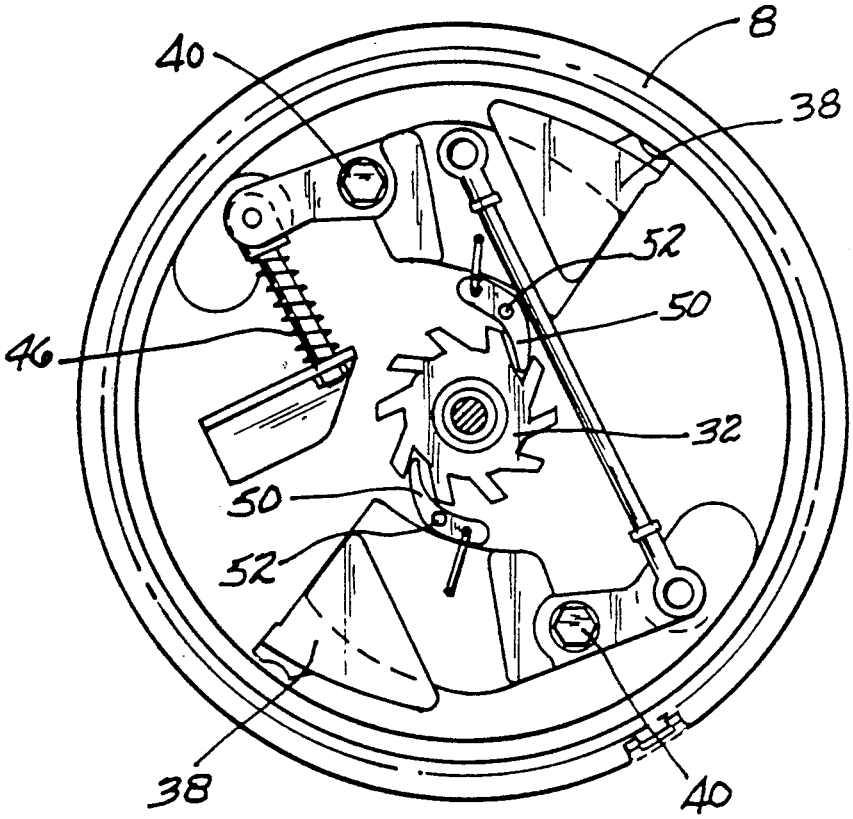
FIG. 4 is a view similar to FIG. 3 but showing the operation of the pawl-flyweight mechanism to engage the ratchet wheel upon overspeed of the governor pulley.
Figure 5:
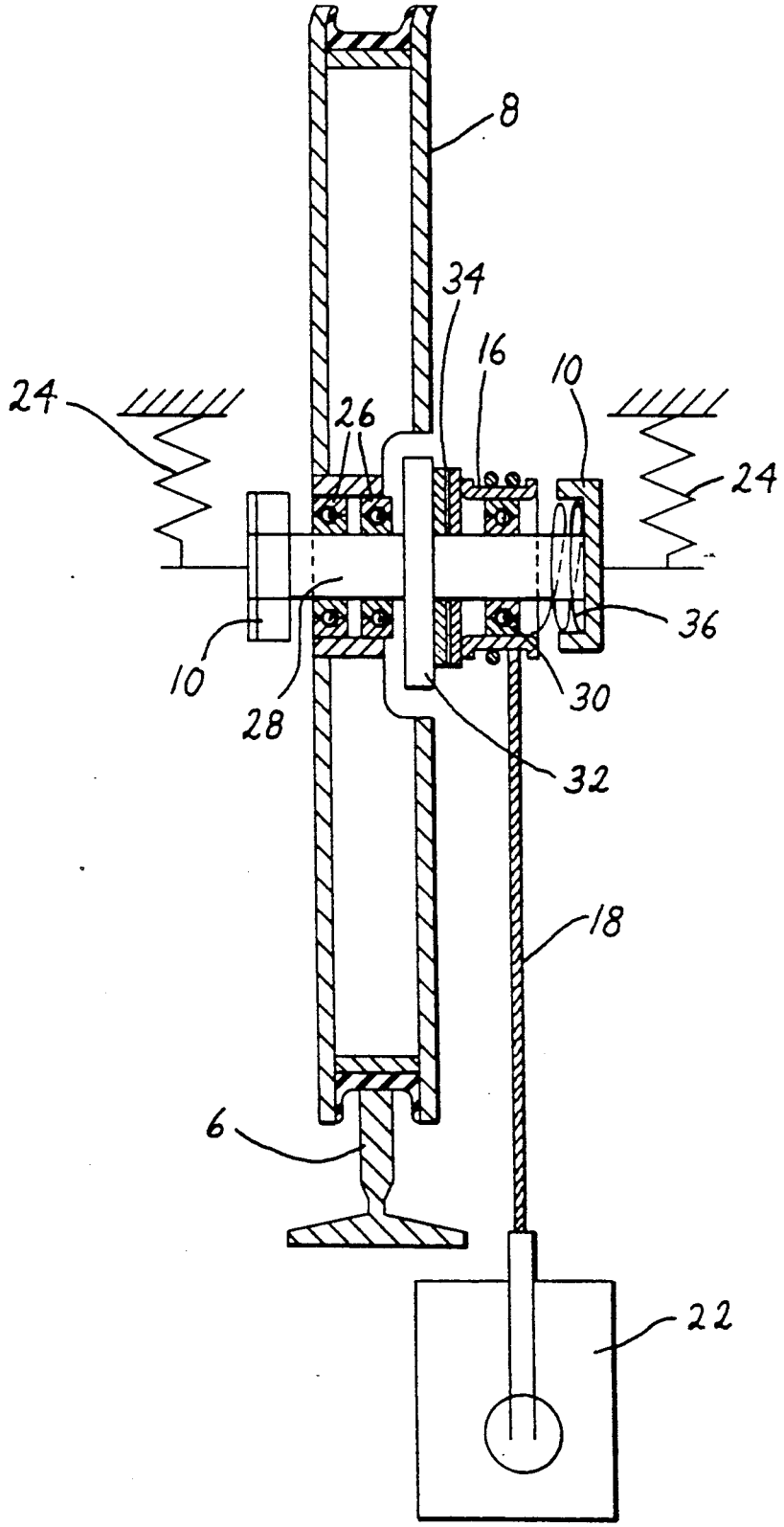
FIG. 5 is an end elevational view of the governor pulley showing its relationship with the safety cable reel.

Referring to FIGS. 3–5, details of the flyweight, pawl and ratchet wheel combination are disclosed. The governor pulley 8 is biased by springs 24 toward the rail 6 so as to assure proper driving contact between the rail 6 and the pulley 8. The pulley 8 is mounted on bearings 26 on a fixed shaft 28 so as to be rotatable on the shaft 28. The reel 16 is also rotatably mounted on the shaft 28 via bearings 30. A ratchet wheel 32 is rotatably mounted on the shaft 28 and is drivably connected to the reel 16 for concurrent rotation therewith. The connection can be a permanent fixed connection, or can be an interruptible connection, such as a slip clutch 34. A torsion spring 36 mounted on the stand 10 and connected to the reel 16 biases the reel 16 in a manner operable to take up slack in the tripping cable 18.

Referring to FIG. 3, the pulley overspeed actuator is shown in detail. A pair of flyweights 38 are mounted on the pulley 8 for pivotal movement thereon about posts 40. The flyweights 38 are connected together by a tie-rod 42 so that pivotal movement of one flyweight results in corresponding pivotal movement of the other flyweight. A bracket 44 is mounted on the pulley 8 and serves as a seat for a coil spring 46 which is mounted on a spring guide 48. The coil spring 46 biases the flyweights 38 in a clockwise direction about the posts 40. A pair of pawls 50 are pivotally mounted on the pulley 8 on pins 52. The pawls 50 are connected to the flyweights 38 by wire clips 54 which coordinate pivotal movement of the pawls 50 with pivotal movement of the flyweights 38. As shown in FIG. 3, the flyweights 38 are biased about the posts 40 in a clockwise direction by the spring 46, and the pawls 50 are biased in a counter-clockwise direction about the pins 52 as a result of the pawls 50 being connected to the flyweights 38. The pawls 50 are thus held away from the ratchet wheel 32. In the condition shown in FIG. 3, the pulley 8 can rotate about the shaft 28 while the ratchet 32 and reel 16 stay still.

This relationship will continue so long as the rotational speed of the pulley 8 stays below a preset value. This value is controlled by the spring 46 and the mass of the flyweights 38. As previously noted, the rotational velocity of the pulley 8 is directly proportional to the speed of the car in the hoistway. Excessive car speed will result in the rotational speed of the pulley 8 exceeding its preset value. This condition will cause the flyweights 38 to pivot about the posts 40 in the counter-clockwise direction compressing the spring 46 and pivoting the pawls 50 about their pins 52 in the clockwise direction. When this happens, the pawls 50 will engage the ratchet wheel 32, as shown in FIG. 4, thereby providing a driving connection between the pulley 8 and the reel 16. Thereafter, continued rotation of the pulley 8 will rotate the ratchet wheel 32 and reel 16. Rotation of the reel 16 will pull or wind up the trip cable 18 onto the reel 16, thereby tripping the safety brake 22 to stop the elevator.

Figure 6:
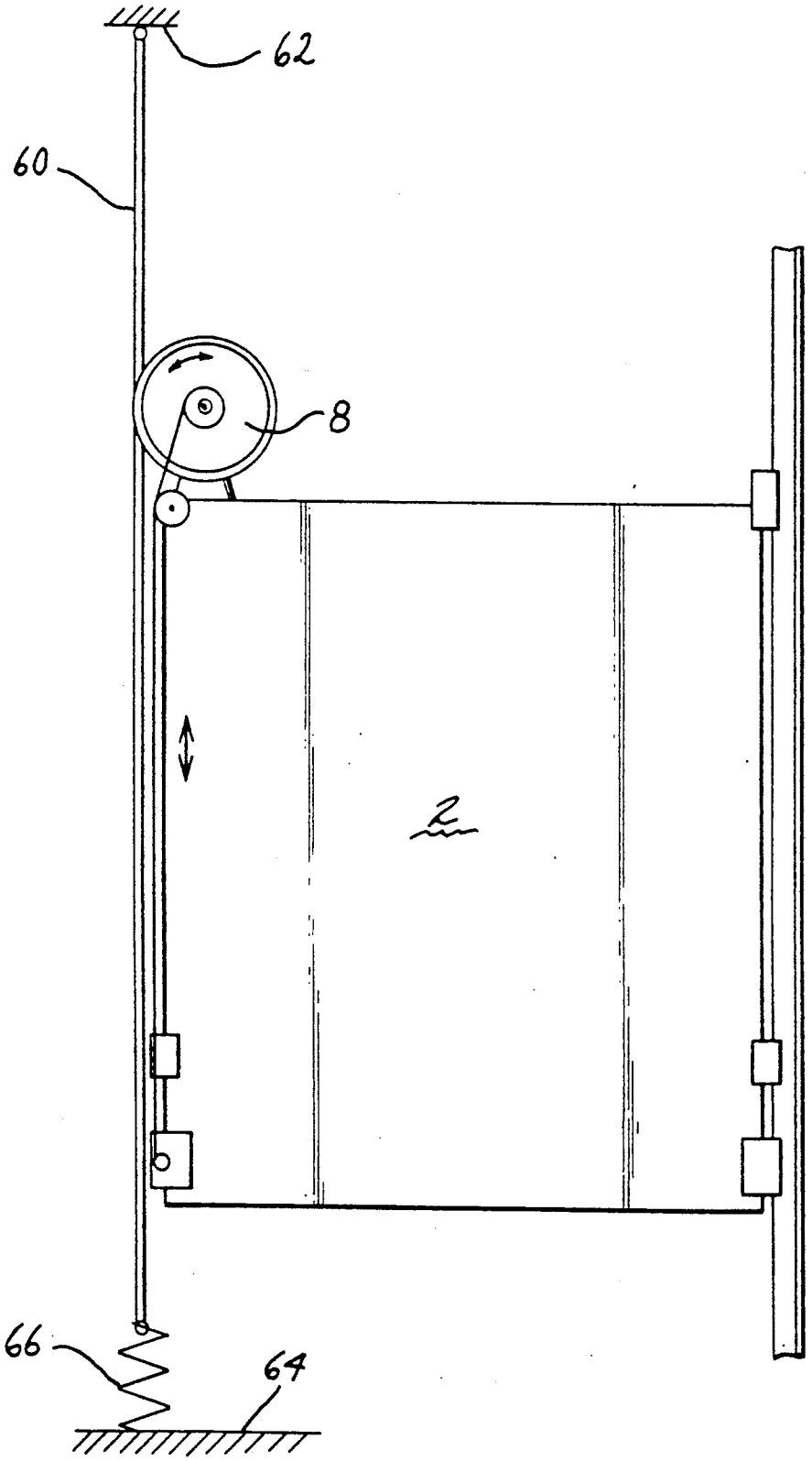
FIG. 6 is a view similar to FIG. 1 but showing an embodiment of the invention wherein the governor pulley engages a fixed cable strung between the top and bottom of the hoistway to sense car speed.
Figure 7:
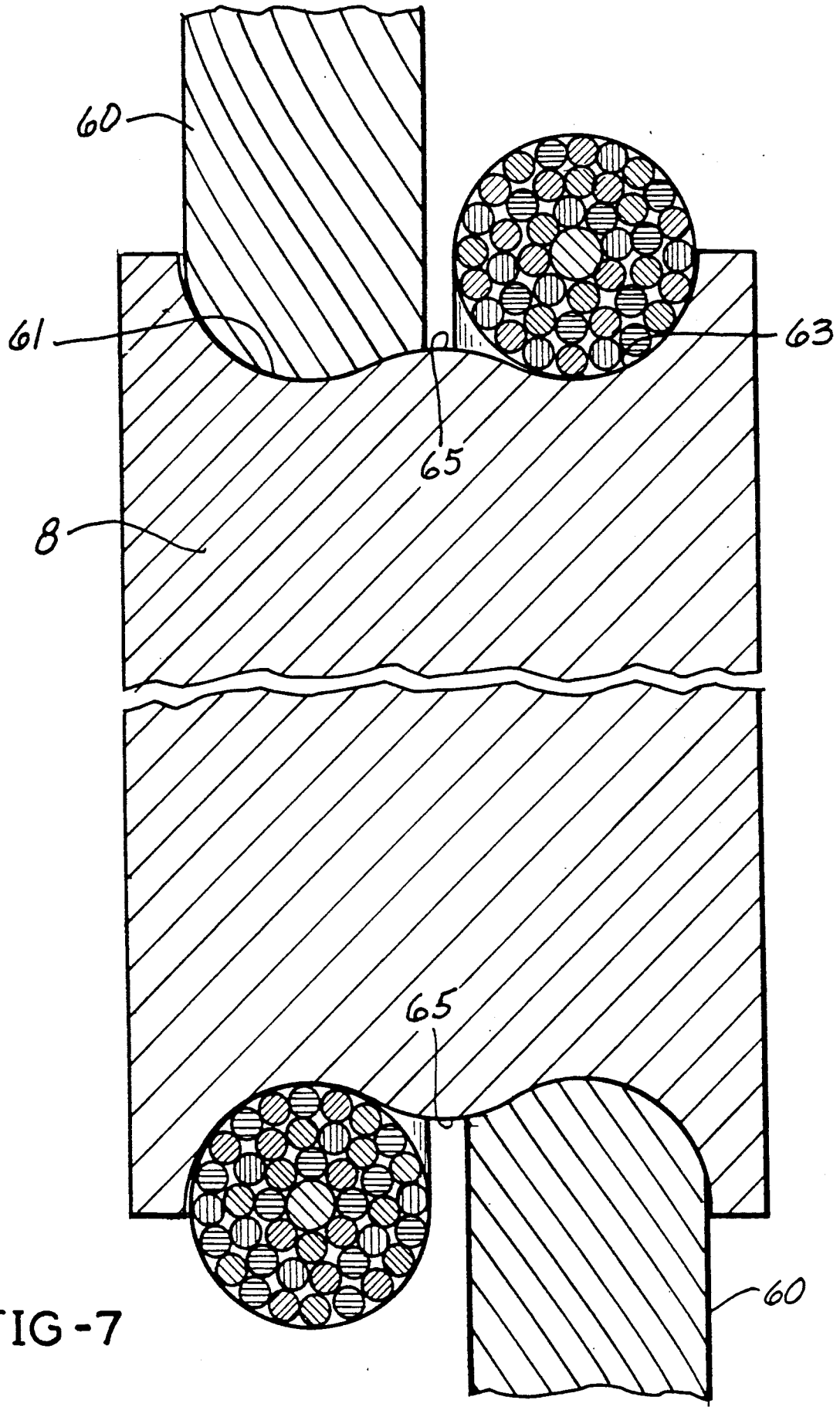
FIG. 7 is a fragmented sectional view of the governor pulley of FIG. 6.

Referring to FIG. 6, a second embodiment of the governor is shown wherein the pulley 8 is rotated by having a cable 60 wound 360° around the circumference of the pulley 8. The cable 60 has its upper end fixed to the top 62 of the hoistway, while its lower end is secured to the bottom 64 of the hoistway by means of a tensioning device 66. The concept here is that a moving loop of governor ropes is replaced by a single rope fixed at the top of the hoistway and tensioned at the bottom of the hoistway by a spring or tensioning weight. The governor rope is wrapped 360° around the governor pulley, providing a driving means for the pulley with this arrangement, the pulley speed is proportional to the car speed, but the single governor rope remains stationary with respect to the hoistway, eliminating the need for a governor pulley in the pit. The required length of governor rope is reduced by half, compared to existing practice. The pulley grooves 61 and 63 are shown in FIG. 7. They are separated by a radiused central section 65 which keeps the cable reaves separate but allows crossover from one groove to the other. It will be noted that the cable 60 is fed onto and paid off of a section of the pulley 8 which is outboard of the side of the car 2 so as to provide smooth and quiet operation. Instead of using a tensioning spring 66, a suspended weight can be used in a frame for tensioning the cable 60.

It will be readily appreciated that the governor assembly of this invention can be used in elevator systems, such as hydraulic and linear induction motor elevators which do not have machine rooms. The governor and emergency brake tripper can be adjusted as to actuation speed, thus the assembly can be used on relatively low speed elevators. The use of the separate governor pulley and tripping cable reel allows the achievement of a mechanical advantage through proper sizing of the governor pulley and cable reel, the pulley having an appropriately larger diameter. With the mechanical advantage, frictional forces between the governor pulley and rail, or cable, do not need to be unduly large to achieve tripping of the emergency brake.

Since many changes and variations of the disclosed embodiments of the invention may be made without departing from the inventive concept, it is not intended to limit the invention otherwise than as required by the appended claims.

What is claimed is:

1. In combination with an elevator system having a car mounted for vertical movement in a hoistway along guide rails mounted in the hoistway, which car is equipped with emergency brakes actuable upon car overspeed, a governor assembly for actuating the emergency brakes, said governor assembly comprising:

a) a governor sheave mounted on the car;

b) a fixed element in the hoistway for driving engagement with the governor sheave whereby resultant rotational speed of the governor will be proportional to the speed of the car in the hoistway;

c) a rotatable reel mounted on the car;

d) an emergency brake cable wound on said reel and connected to the emergency brakes whereby winding of the emergency brake cable onto the reel will activate the emergency brakes; and e) means for selectively connecting said governor sheave to said reel when the rotational speed of the governor sheave reflects car overspeed, whereupon said governor sheave will drive said reel to wind the emergency brake cable onto said reel and actuate the emergency brakes.

2. The combination of claim 1 wherein said fixed element is a fixed cable stretched between the hoistway roof and the pit, and wound about said governor sheave.

3. The combination of claim 2 wherein said governor sheave projects beyond a side wall of the car to receive the fixed cable.

4. The combination of claim 3 further comprising means in the hoistway pit connected to the fixed cable and operable to impart a constant tension to the fixed cable to accommodate variations in the true length of the fixed cable.

5. The combination of claim 2 wherein said governor sheave has a pair of peripheral grooves for receiving the wound fixed cable therein.

6. The combination of claim 1 wherein said fixed element is one of the car guide rails.

7. The combination of claim 1 wherein said means for selectively connecting comprises a ratchet wheel operably connected to said reel; pawl means mounted on said governor sheave; and centrifugal means mounted on said governor sheave and operable to connect said pawl means with said ratchet wheel upon car overspeed rotation of said governor sheave.

8. The combination of claim 7 further comprising spring means for biasing said reel to maintain a taut condition in said emergency brake cable.

9. The combination of claim 1 wherein said governor sheave is of larger diameter than said reel to impart a mechanical advantage to the governor assembly.

* * * * *